US007059110B2

(12) United States Patent
Anderegg et al.

(10) Patent No.: US 7,059,110 B2
(45) **Date of Patent: *Jun. 13, 2006**

(54) SPINNING DEVICE FOR PRODUCTION OF SPUN THREAD FROM A FIBRE SLIVER

(75) Inventors: Peter Anderegg, Witnerthur (CH); Herbert Stalder, Kollbrunn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 5 days.

This patent is subject to a terminal disclaimer.

(21) Appl. No.: 10/381,156

(22) PCT Filed: Sep. 19, 2001

(86) PCT No.: PCT/CH01/00569

§ 371 (c)(1),
(2), (4) Date: Sep. 5, 2003

(87) PCT Pub. No.: WO02/24993

PCT Pub. Date: Mar. 28, 2002

(65) Prior Publication Data

US 2004/0025488 A1 Feb. 12, 2004

(30) Foreign Application Priority Data

Sep. 22, 2000 (CH) ..... 1845/00

(51) Int. Cl.
*D01H 4/02* (2006.01)

(52) U.S. Cl. ..... 57/400; 57/328; 57/350

(58) Field of Classification Search ..... 57/289, 57/328, 333, 350, 400, 403
See application file for complete search history.

(56) References Cited

U.S. PATENT DOCUMENTS 5,159,806 A * 11/1992 Mori et al. ..... 57/328
5,193,335 A * 3/1993 Mori ..... 57/296
5,211,001 A * 5/1993 Mori
5,295,349 A * 3/1994 Okamoto ..... 57/333
5,390,485 A * 2/1995 Mori ..... 57/328
5,528,895 A * 6/1996 Deno
5,647,197 A * 7/1997 Imamura (Continued)

FOREIGN PATENT DOCUMENTS

DE 19926492 * 4/2000

(Continued)

OTHER PUBLICATIONS

PCT Search Report Dec. 14, 2002.*

*Primary Examiner*—John J. Calvert
*Assistant Examiner*—Shaun R. Hurley
(74) *Attorney, Agent, or Firm*—Dority & Manning, P.A.

(57) ABSTRACT

A device for the manufacture of a spun thread from a fiber sliver includes a fiber conveying channel with a fiber guidance surface. A yarn guidance channel includes an inlet mouth aperture disposed such that the fiber guidance surface guides fibers to the inlet mouth aperture. A fluid generating device creates eddy currents around the inlet mouth aperture to incorporate individual fibers into an end of a yarn being formed in the yarn guidance channel. The fiber guidance surface includes a fiber delivery edge having a shape and disposed relative to the inlet mouth aperture such that the fibers are guided over the delivery edge and conveyed to the inlet mouth aperture in an aligned generally flat planar formation.

20 Claims, 10 Drawing Sheets

U.S. PATENT DOCUMENTS 5,813,209 A * 9/1998 Hirao et al. ..... 57/261
5,927,062 A * 7/1999 Deno et al.
6,058,693 A * 5/2000 Stahlecker et al.
6,209,304 B1 * 4/2001 Feuerlohn et al.
2003/0177751 A1 * 9/2003 Stalder et al. ..... 57/403

FOREIGN PATENT DOCUMENTS

JP 3106368 * 11/1991

* cited by examiner

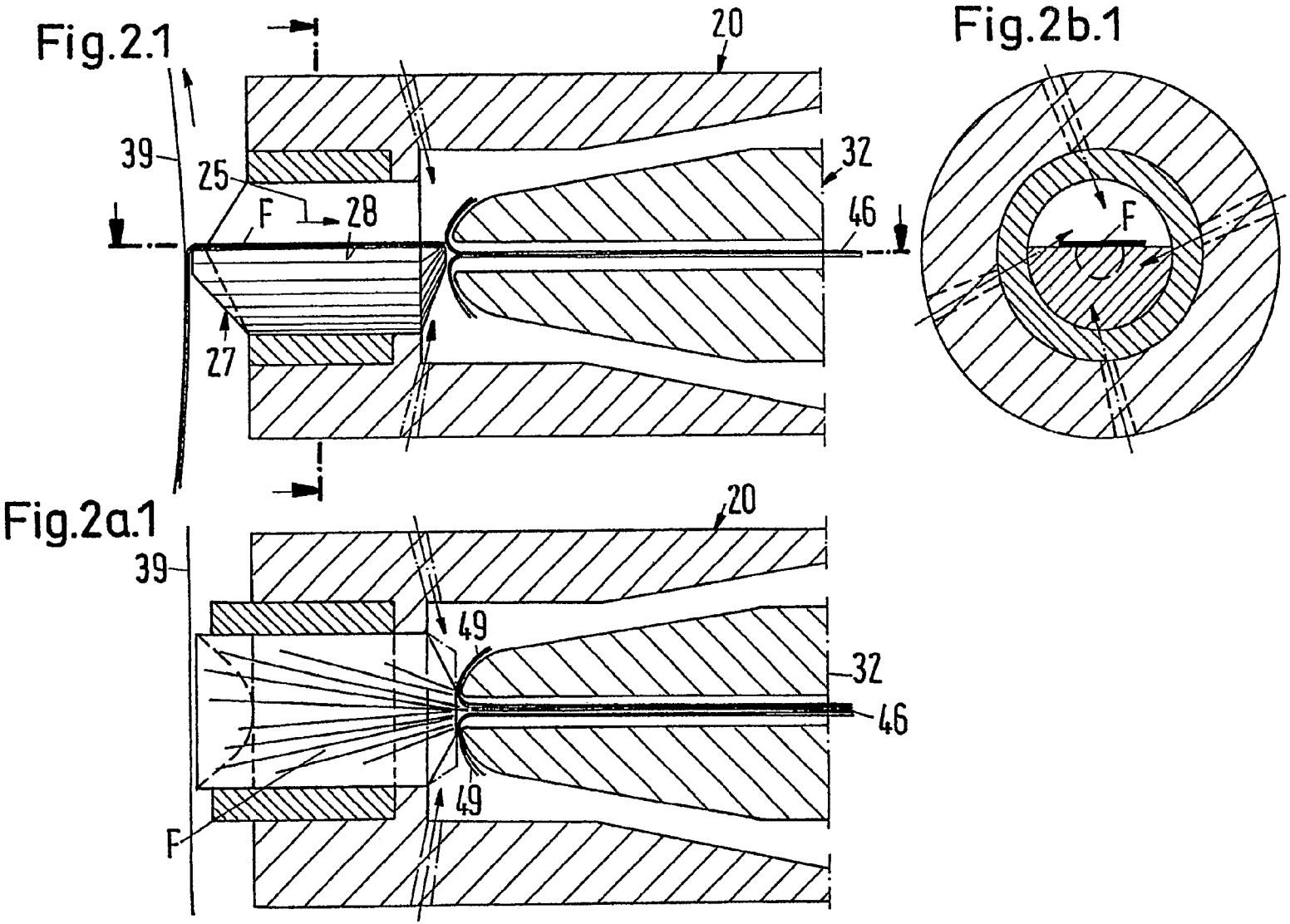
Fig.2b.1
F
Fig.2.1
20
32
46
28
F
25
27
39
I
I
Fig.2a.1
20
32
46
49
49
39
F 26
28.1

26
29
M
40
N
28.1

28.2

28.3

28.4

29
30.1
R.2
D.2

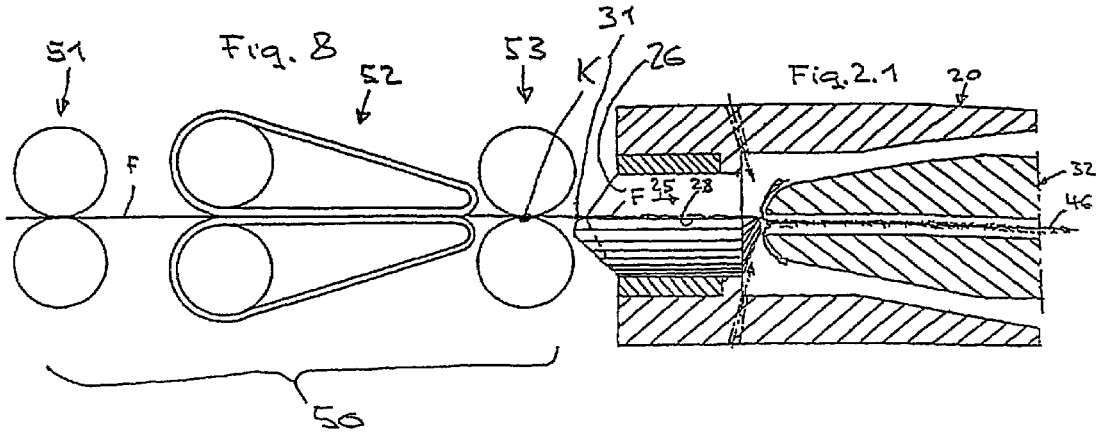
51
Fig. 8
52
53
31
K
26
Fig. 21
20
F
F
25
28
32
46
50
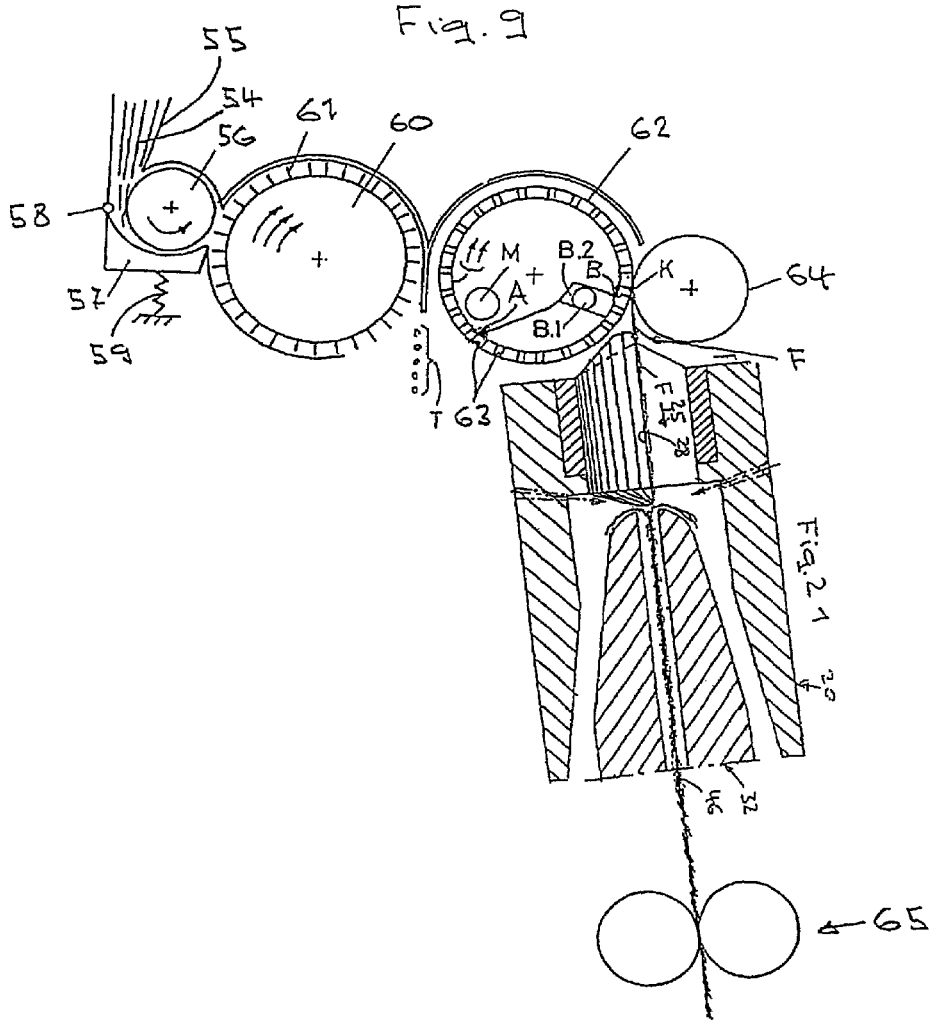
Fig. 9
55
54
56
61
60
62
58
57
59
M
B.2
B
K
64
A
B.1
F
T
63
F
25
28
Fig. 21
20
46
32
65

SPINNING DEVICE FOR PRODUCTION OF SPUN THREAD FROM A FIBRE SLIVER

FIELD OF THE INVENTION

The invention relates to a device for the production of a spun thread from a fibre sliver, encompassing a fibre conveying channel with a fibre guide surface for the guidance of the fibres of the fibre sliver into the inlet aperture mouth of a yarn guidance channel, and further comprises a fluid device for the production of an eddy current around the inlet aperture mouth of the yarn guidance channel.

BACKGROUND

Such a device is known from DE 44 31 761 C2 (U.S. Pat. No. 5,528,895) and is shown in FIGS. 1 and 1*a*. In this, fibres are guided through a fibre bundle passage 13 on a twisted fibre guidance surface, which exhibits a "rear" edge 4*b* about a "front" edge 4*c*. The fibres are then guided around what is referred to as a needle 5 into a yarn passage 7 of what is referred to as a spindle 6, whereby the rear part of the fibres are rotated by means of an eddy current generated by nozzles 3 about the front part of the fibres, already located in the yarn passage, with a yarn being formed as a result. Once this has been done, spinning takes place, as is described later in connection with the invention.

The element referred to as the needle, and its tip about which the fibres are guided, is located close to or in the inlet aperture mouth 6*c* of the yarn passage 7 and serves as what is referred to as a false yarn core, in order as far as possible to prevent or to reduce the possibility that, due to the fibres in the fibre bundle passage, an impermissibly high false twist of the intertwined fibres occurs, which would at least interfere with the formation of the yarn if not even preventing it altogether.

FIG. 1*b* shows this aforementioned prior art encumbered with disadvantages (DE 41 31 059 C2, U.S. Pat. No. 5,211,001), in that, as is known from DE 44 31 761, FIG. 5, the fibres are not guided consistently about the needle as shown in FIG. 1*a*, but are guided on both sides of this needle against the inlet aperture mouth of the yarn passage, which apparently interferes with the binding of the fibres and apparently can lead to a reduction of the strength of the spun yarn.

FIG. 1*c* shows a further development of FIG. 1, or 1*a* respectively, in that the fibre guidance surface 4*b*, as can be seen, is designed in a helical shape, and the fibres are accordingly likewise guided in helical form in their course from the clamping gap X as far as the end e5 of the helical surface, and are then wound, still in helical form, about a fibre guidance pin, similar to the fibre guidance pin 5 of FIG. 1, before the fibres are acquired by the rotating air flow and twisted to form a yarn Y. In this situation, it can be seen that the rear ends of the fibres f" are bent about the mouth part of the spindle 6, and in this context are taken up by the rotating air flow and wound around the front ends, which are already located in the center of the fibre run, in order to form the yarn as a result.

FIG. 1*c* corresponds to FIG. 6 from DE 19603291 A 1 (U.S. Pat. No. 5,647,197), whereby the identification references of the spindle 6, the yarn passage 7, and the venting cavity 8 have been adopted from FIG. 1, while the element e2, which has a similar function to the needle 5 of FIGS. 1 to 1*b* has been left as it was. It can likewise be seen from this FIG. 1*c* that the fibres are transferred from a helical formation to the inlet of this spindle.

A further prior art from the same Applicants is specified in JP 3-10 64 68 (2) and seen in FIGS. 1*d* and 1*e*, which, by contrast with FIG. 1, does not exhibit a needle, but rather a truncated cone 5*a* with a flat fibre guidance surface, which is a part of the fibre guidance channel 13, and the tip of which is arranged essentially concentric to the fibre guidance run 7. The purpose of this cone is the same as that of the tip 5, namely of producing what is referred to as a false yarn core in order to prevent the fibres from being incorrectly twisted; in other words, that a false twist occurs from the tip backwards against the clamping gap of the output rollers, which would at least in part prevent a true twist of the fibres such as to form the yarn.

SUMMARY

Objects and advantages of the invention will be set forth in part in the following description, or may be obvious from the description, or may be learned through practice of the invention.

The problem was therefore to find a method and device in which the fibres undergo fibre guidance by means of which the fibres can be taken up by the air eddy which is created in such a way that a uniform and firm yarn can be produced.

The problem was resolved in that a fibre guide surface exhibits a fibre delivery edge, over and by means of which the fibres are guided in a formation lying essentially flat next to one another, against an inlet aperture mouth of a yarn guidance channel.

Further advantageous embodiments are provided in the other dependent claims.

The invention is described hereinafter in greater detail on the basis of drawings which represent only some means of implementation.

BRIEF DESCRIPTION OF THE DRAWINGS

FIG. 2.1 The same embodiment as FIG. 2, whereby the fibre or yarn flow is additionally shown;

FIG. 2*a*.1 Corresponds to FIG. 2*a*, whereby the fibre or yarn flow is additionally shown, and a possible modification of the fibre delivery edge is also represented;

FIG. 2*b*.1 Corresponds to FIG. 2*b*, whereby the fibre or yarn flow is additionally shown;

FIG. 8 A representation of a drafting device as a fibre feed into the element of FIG. 2.1; and FIG. 9 A representation of a fibre releasing device as a fibre feed into the element of FIG. 2.1.

SUPPLEMENTARY DESCRIPTION OF THE PRIOR ART

Figure 1:
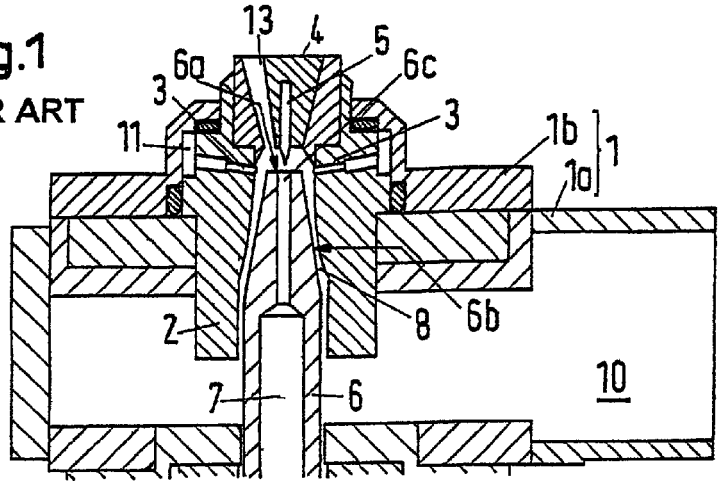
Fig.1 PRIOR ART
FIGS. 1–1*c* Figures from DE 44 31 761 C2, whereby FIG. 1*b* corresponds to the device from DE 41 31 059 C2 and FIG. 1*c* the device from DE 19 60 32 91 A1, corresponding to figures from JP3-10 63 68 (2)

FIG. 1 shows a housing 1 with the housing parts 1*a* and 1*b* and with a nozzle block 2 integrated in it which contains jet nozzles 3, by means of which an eddy current as described heretofore is created, as well as what is referred to as a needle holder 4 with the needle 5 inserted in it.

Figure 1B:
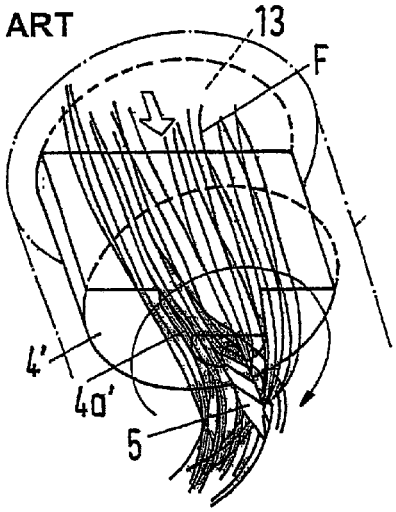
Fig.1b PRIOR ART
FIGS. 1*d* and 1*e* Figures from JP3-10 63 68 (2)
Figure 1A:
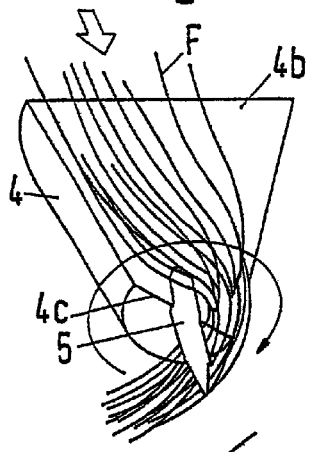
Fig.1a PRIOR ART

As can be seen from FIG. 1*a*, the eddy current produces a right-hand swirl in the direction of the arrow (seen looking towards the Figure), and accordingly the fibres F being delivered are conducted in this direction of rotation about the needle 5 against a face side 6*a* of what is referred to as the spindle 6 (FIG. 1), and introduced into a yarn passage 7 of the spindle 6. In this situation, a relatively large distance interval pertains between the nozzle block 2 and the face side 6*a* of the spindle, since space must pertain in this distance interval for the needle 5 and its tip.

The fibres F are conveyed in a fibre guidance channel 13 on what is referred to as the fibre guide surface, by way of an aspirated air flow, against the tip of the needle 5.

The aspirated air flow is created on the basis of an injector effect of the nozzle jets 3, which are provided in such a way that, on the one hand the air eddy referred to is created, while on the other air is also sucked in through the fibre conveying channel 13.

This air escapes along a conical section 6*b* of the spindle 6 through an air escape cavity 8 into an air outlet 10.

The compressed air for the jet nozzles 3 is delivered to the jet nozzles in a uniform manner by means of a compressed air distribution chamber 11.

FIG. 1*b*, which represents the prior art to FIGS. 1 and 1*a* referred to heretofore, shows that this Figure, by contrast with FIG. 1*a*, additionally exhibits a needle holder extension piece 4*a*', which projects from a face surface 4' and contains the needle 5; i.e. the fibres are guided over the entire extension, which pertains because of the contour of the needle holder 4, against the inlet of the spindle 6.

Figure 1C:
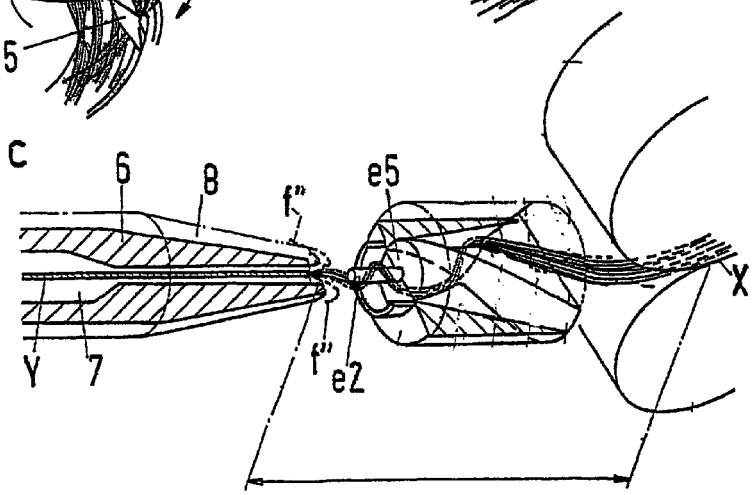
Fig.1c PRIOR ART
Figure 1D:
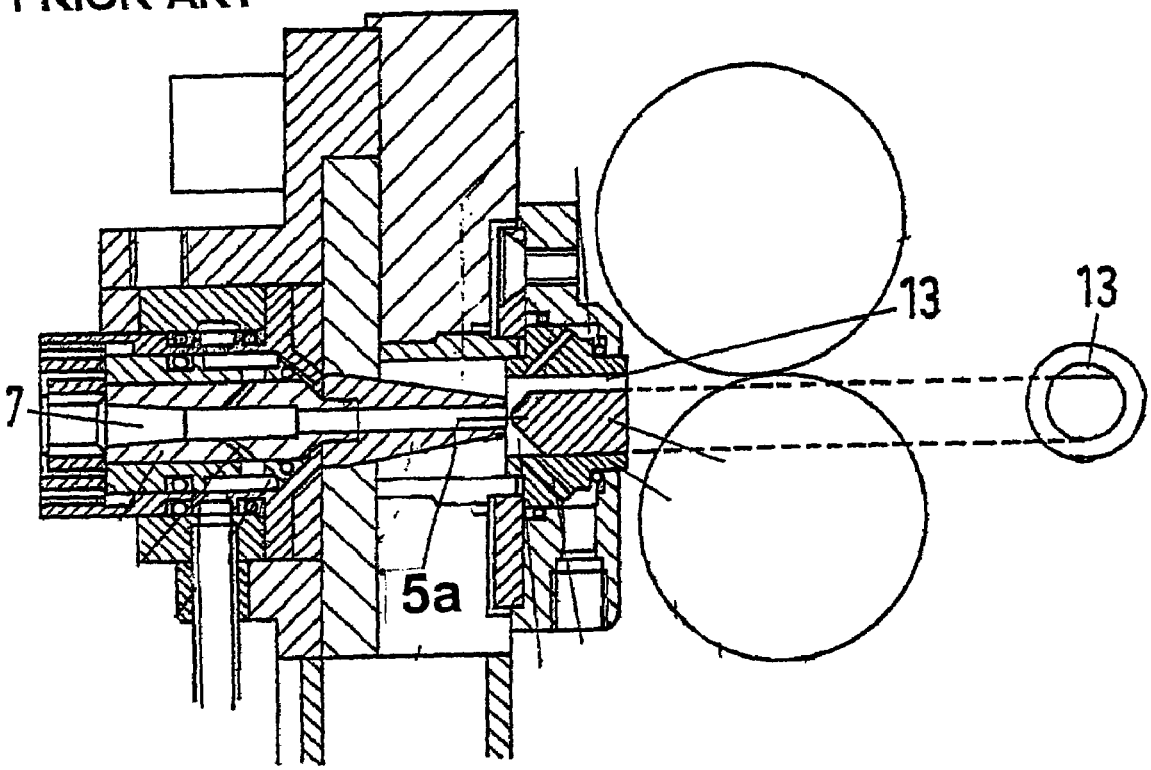
Fig.1d PRIOR ART
Figure 1E:
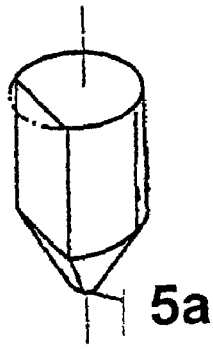
Fig.1e PRIOR ART

FIGS. 1*c* to 1*e* have already been discussed. In this situation, the identification numbers of these Figures which have not been mentioned do not have any explanation in this application. The disadvantage of these devices lies in the uncertain fibre guidance at a large distance interval from the face side of the needle holder 4 to the inlet mouth aperture 6*c* in the face side 6*a* of the spindle 6, as well as in the guidance of the fibres to or about the needle 5 or the cone element 5*a* of FIGS. 1*d* and 1*e* respectively.

DETAILED DESCRIPTION

Reference is now made to embodiments of the invention, one or more examples of which are illustrated in the drawings. The embodiments are provided by way of explanation of the invention, and not meant as a limitation of the invention. It is intended that the invention include modifications and variations to the embodiments described herein.

Figures 2, 2A, 2B, 2C:
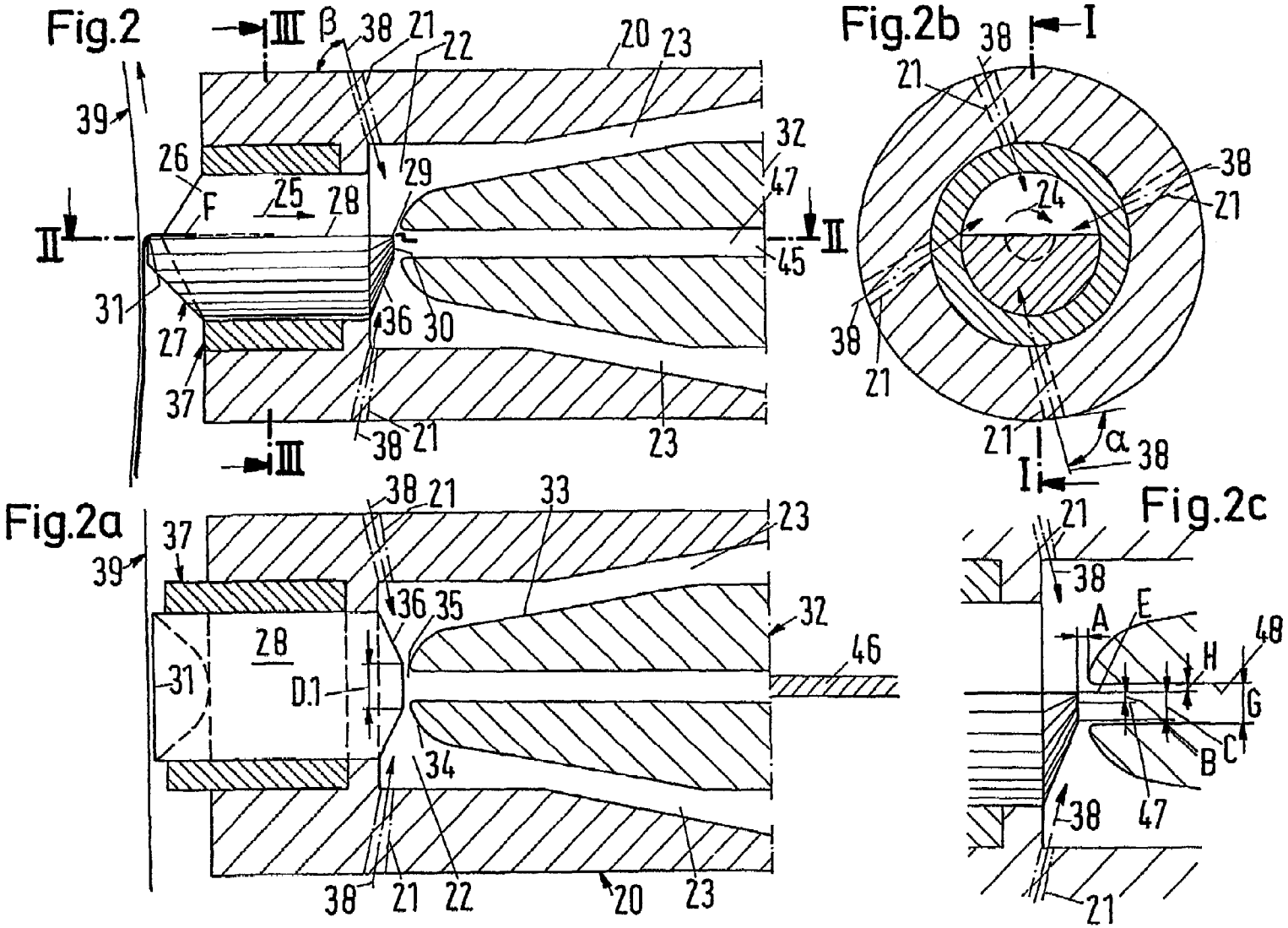
FIG. 2 A first embodiment of the invention essentially according to the section lines I—I (FIG. 2*b*), whereby a middle element is represented not in section.
FIG. 2*a* A section according to the sectional lines II—II of FIG. 2.
FIG. 2*b* A cross-section according to the section lines III—III of FIG. 2.
FIG. 2*c* Represents a section taken from FIG. 2, represented as an enlargement.

In order to alleviate certain disadvantages of the prior art devices, according to FIGS. 2–2*c* the invention exhibits a fibre delivery edge 29, which is located very close to an inlet mouth aperture 35 (FIG. 2*a*) of a yarn guidance channel 45, which is provided inside what is referred to as a spindle 32. For a special advantage, a specified distance interval A (FIG. 2*c*) is defined between the fibre delivery edge 29 and the inlet mouth aperture 35, and with a specified distance interval B between an imaginary plane E which contains the edge, this plane running parallel to a mid-line 47 of the yarn guidance channel 45, and this aforesaid mid-line 47.

In this situation the distance interval A, depending on the fibre type and mean fibre length, and on the relevant experimental results, corresponds to a range from 0.1 to 1.0 mm. The distance interval B depends on the diameter G of the inlet aperture mouth 35, and, depending on experimental results, lies within a range from 10 to 40% of the diameter G referred to.

In addition to this, the fibre delivery edge exhibits a length D.1 (FIG. 2*a*), which is in a proportion of 1:5 to the diameter G of the yarn guidance channel 45, and is formed by a face surface 30 (FIG. 2) of a fibre conveying element 27 and a fibre guidance surface 28 of the element 27. In this situation, the face surface 30, with a height C (FIG. 2*c*), lies within the range of the diameter G and exhibits an empirically-determined distance interval H between the plane E and the opposite inner wall 48 of the yarn guidance channel 45.

The fibre conveying element 27 is guided in a carrier element 37 accommodated in a nozzle block 20, and together with this carrier element forms a free space which creates a fibre conveying channel 26.

The fibre conveying element 27 exhibits at the inlet a fibre take-up edge 31, about which the fibres are guided, these being conveyed by a fibre conveying roller 39. These fibres are raised from the fibre conveying roller 39 by means of a suction air flow from the conveying roller, and conveyed through the fibre conveying channel 26. The suction air flow is created by an air flow generated in jet nozzles 21 with a blast direction 38, on the basis of an injector effect.

The jet nozzles, as represented in FIGS. 2 and 2*b*, are arranged in a nozzle block 20 on the one hand at an angle β (FIG. 2), in order to create the injector effect referred to heretofore, and, on the other, are offset at an angle α (FIG. 2*b*), in order to create an air eddy which rotates with a direction of rotation 24 along a cone 36 of the fibre conveying element 27, and about the spindle front surface 34 (FIG. 2*a*), in order, as described hereinafter, to form a yarn in the yarn guidance channel 45 of the spindle 32.

The air flow created by the nozzles 21 in an eddy chamber 22 escapes along a spindle cone 33, through an air escape channel 23 formed around the spindle 32, into the atmosphere or into a suction device.

To form a yarn 46 (FIG. 2*a*), the fibres F which are delivered from the fibre conveying roller 39, are raised from the fibre conveying roller 39 by means of the suction air flow referred to in the fibre conveying channel 26, and are guided on the fibre guidance surface 28 in a conveying direction 25 (FIG. 2) against the fibre delivery edge 29. From this delivery edge, front ends of the fibres are guided through the spindle inlet aperture mouth 35 into the yarn guidance channel 45, while the rear ends or the rear part 49 of these fibres are folded over as soon as the rear ends are free and taken up by the rotating air flow, so that, with the further conveying of the fibres in the yarn guidance channel 45, a yarn 46 is created which exhibits a yarn character similar to the ring yarn.

This process is represented in FIGS. 2.1 to 2*b*.1. It can be seen in these figures that the fibres F delivered with the fibre delivery roller 39 are conducted in the conveying direction 25 on the fibre guidance surface 28 against the fibre delivery edge 29, and specifically, as shown in FIG. 2*a*.1, with a converging fibre flow, which tapers increasingly towards the inlet aperture mouth 35 (FIG. 2*a*). This tapering is applied because the front ends, which are already incorporated into the twisted yarn 46, have a tendency to migrate in the direction of the tapering, so that front ends of fibres located further to the rear are likewise displaced in the direction of the tapering. This only happens, however, until the rear part 49 of the fibres F have been taken up by the air eddy referred to, and rotated around the spindle front surface 34 and drawn into the inlet aperture mouth 35 at the thread draw-off speed, in the process acquiring the twist necessary for the formation of the yarn.

In FIG. 2*a*, the width D.1, as shown by the broken lines, is represented in extended form, specifically on the one hand in order to show that the width can be extended, and, on the other, likewise to show that this extended width will, under certain circumstances, reduce the size of the eddy chamber shown in FIG. 2*a*, if not even changed with interfering effect, in that the eddy current can no longer develop therein in such a way that the fibre ends 49 can be taken up by the eddy flow with the energy required. This too must be determined by means of empirical experiments.

The yarn formation referred to heretofore takes place after the start of a spinning process of any kind, for example in which a yarn end of an already existing yarn is conducted back through the yarn guidance channel 45 into the area of the spindle inlet mouth aperture 35 sufficiently far for fibres of this yarn end to be opened sufficiently wide by the air flow, which is already rotating, that front ends of fibres which are newly conducted to the fibre guidance channel 26 can be taken up by this rotating fibre sliver and, by repeat drawing of the yarn end which has been introduced, can be held in the sliver such that the following rear parts of the newly-delivered fibres can be wound around the front ends which are already located in the mouth aperture section of the yarn guidance channel, so that, as a consequence, the yarn referred to can be respun with an essentially predetermined arrangement.

The sequence has been described on the basis of an example in which the front end of a fibre, seen in the direction of conveying, is incorporated in the fibre sliver, and the rear end of this fibre is or becomes free to be "folded over." The process can, however, take place in an analogous manner in the case of an incorporated rear end of the fibres, whereby the front end is free, and, because of the axial component of the eddy air flow, is deposited at the spindle front surface 34. The fibre parts which are deposited on the spindle front surface 34 then rotate because of the eddy air flow, and are therefore wound around the fibre ends which have been bound in.

Figures 3, 3A, 3B, 3C, 3D:
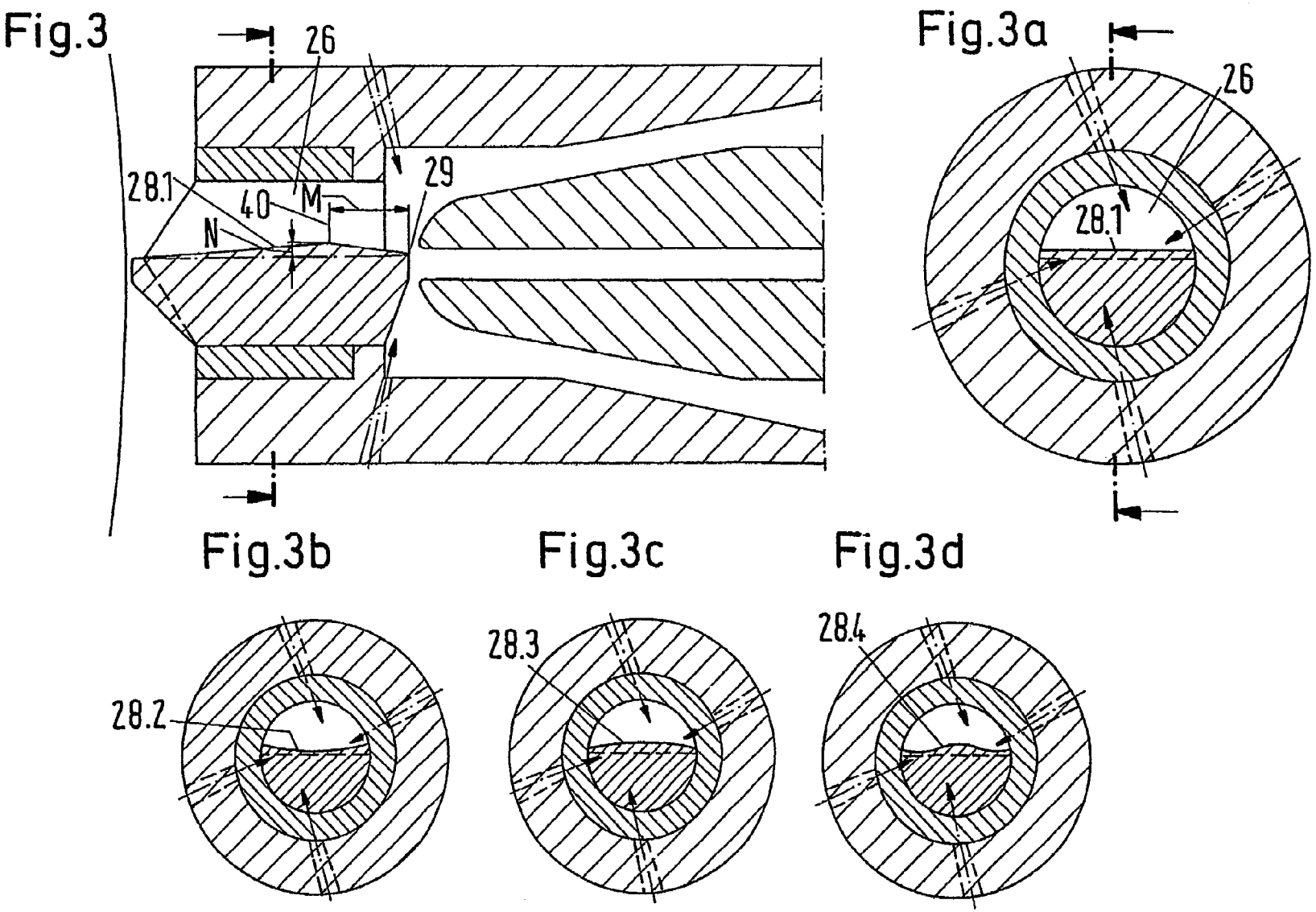
FIG. 3 A second embodiment of the invention, essentially according to the section lines I—I from FIG. 3*a;*
FIG. 3*a* A cross-section according to the section lines III—III of FIG. 3
FIG. 3*b* A cross-section corresponding to FIG. 3*a* through a first variant of the second embodiment.
FIG. 3*c* A cross-section corresponding to FIG. 3*a* through a second variant of the second embodiment.
FIG. 3*d* A cross-section corresponding to FIG. 3*a* through a third variant of the second embodiment.

FIGS. 3 and 3*a* show a further embodiment of the fibre guidance channel 26 of FIGS. 2–2*c*, in this case as the fibre guidance surface 28.1 with an elevation 40 arranged at a distance interval M from the fibre delivery edge 29, over which the delivered fibres slide before they reach the fibre delivery edge 29. In this situation the distance M corresponds to a maximum of 50% of the mean fibre length.

The elevation exhibits a distance interval N to a fibre guidance surface without elevation, which lies within the range of 10 to 15% of the distance interval M.

The distance intervals M and N are to be determined empirically in accordance with the fibre type and fibre length.

This elevation 40 can exhibit the shapes shown with FIGS. 3*a*–3*d*; i.e. the edge can be concave, according to FIG. 3*b*, for example for "slippery" fibres to be explained later, convex according to FIG. 3*c* for "sticky" fibres, or, according to FIG. 3*d*, wave-shaped. Correspondingly, the fibre guidance surfaces of FIGS. 3*b* to 3*d* are designated as 28.2, 28.3, and 28.4.

These shapes serve to provide different fibre guidance on the fibre guidance surface 28.1–28.4, and are to be determined empirically according to the fibre type and fibre length. In this situation, the term "slippery" fibre is understood to mean such as exhibit weak mutual adhesion, and "sticky" fibres such as exhibit a stronger mutual adhesion. The elements which do not have characterization identification correspond to the elements in FIGS. 2 to 2*c*.

A further advantage of the elevation lies in the fact that, due to the movement of the fibres over this point, a loosening of possible dirt particles inside the fibre sliver takes place, which are taken up by the conveying air flow and can be conveyed into the open air or into a suction device.

Figure 4A:
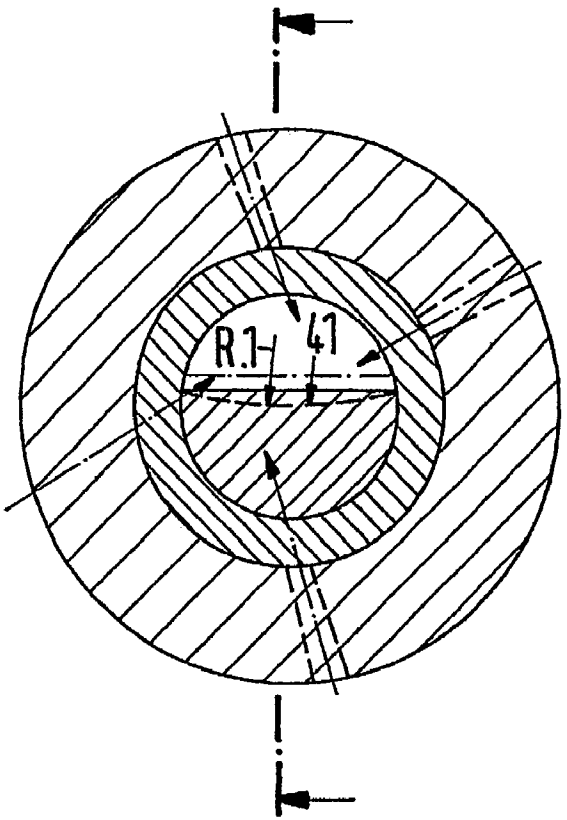
FIG. 4*a* A cross-section according to the section lines III—III of FIG. 4.
Figure 4:
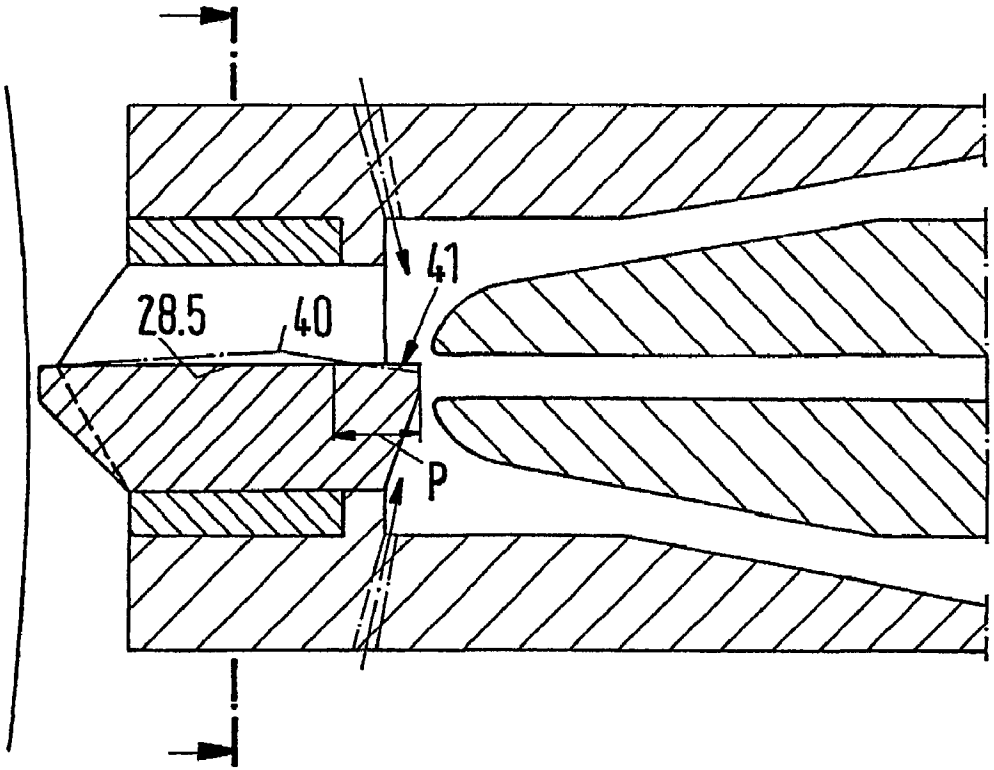
FIG. 4 A third embodiment of the invention, essentially according to the section lines I—I from FIG. 4*a;*

FIGS. 4 and 4*a* show a further variant of the fibre guidance surface 28 of FIGS. 2–2*c*: fiber guidance surface 28.5. According to this variant, the fibre guidance surface exhibits, at a distance interval P from the fibre delivery edge 29 of a maximum of 50% of the mean fibre length, a depression 41 with a radius R.1, whereby the lowest point of the depression 41 is located lower than the edge 29 of FIGS. 2–2*c*. In this situation the depression 41 and the radius R.1 are to be determined empirically on the basis of the fibre type and fibre length, and the depression 41 serves to prevent fibres (short fibres, for example) from moving away sideways, i.e. of being lost as wastage.

As shown in FIG. 4, this variant can also be combined with the elevation 40 (represented by a broken line) of FIGS. 3 and 3*a* or 3*b* to 3*d*.

The elements which do not have characterization identification correspond to the elements in FIGS. 2 to 2*c*.

Figures 5, 5A, 5B:
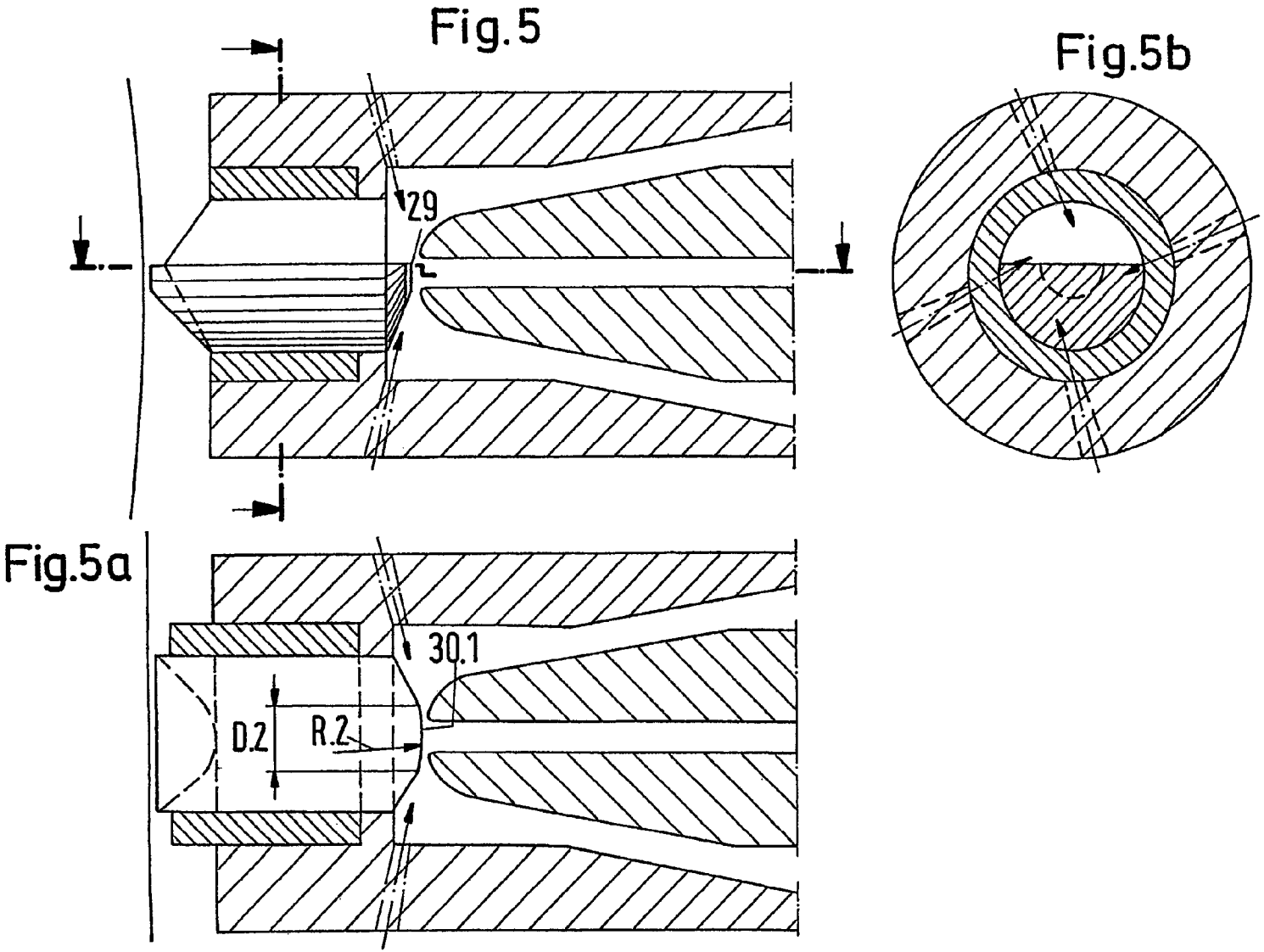
FIGS. 5–5*b* A further variant of the invention according to FIGS. 2–2*b;*

FIGS. 5–5*b* show a further variant of the design of the fibre delivery edge 29, in that the face surface 30.1 exhibits a convex rounding provided with a radius R.2, and in this situation the fibre delivery edge 29 acquired a width D.2. In this case too, the selection of the radius and the width is a matter of empirical experiments, in order to be able to adapt to the fibre type and fibre length in a way optimum for the yarn formation. In this situation, measures can also be applied to influence the optimization of the eddy chamber 22 from the technical flow point of view, as mentioned earlier.

The elements which do not have characterization identification correspond to the elements in FIGS. 2 to 2*c*.

Figure 6B:
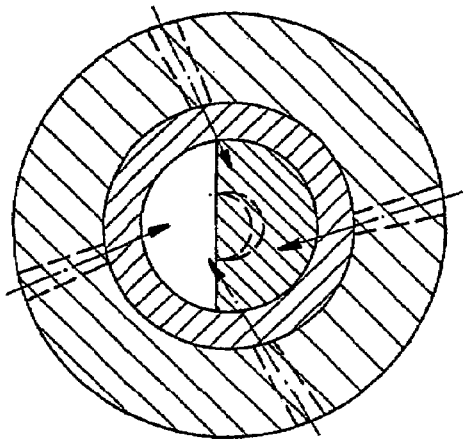
FIGS. 6–6*b* Another variant of the invention according to FIGS. 2–2*b;*
Figure 6:
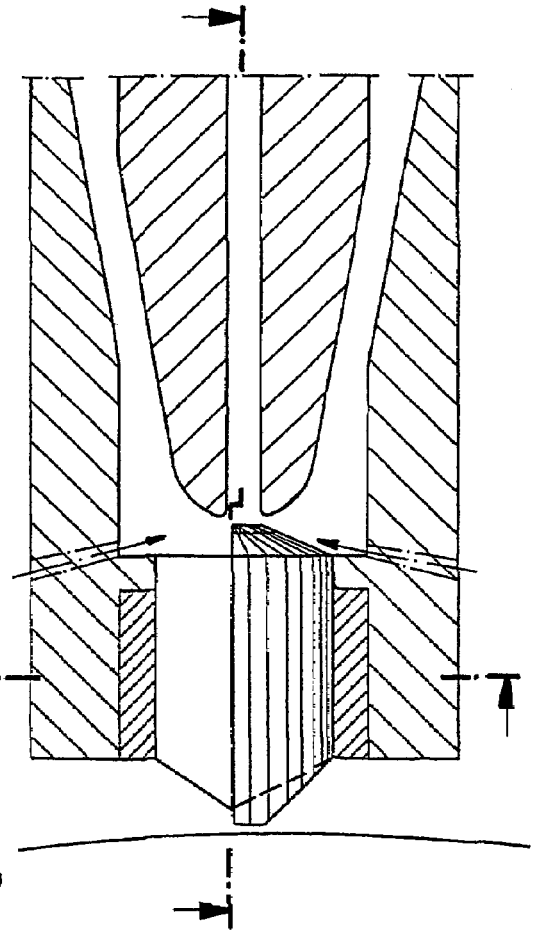
Figure 6A:
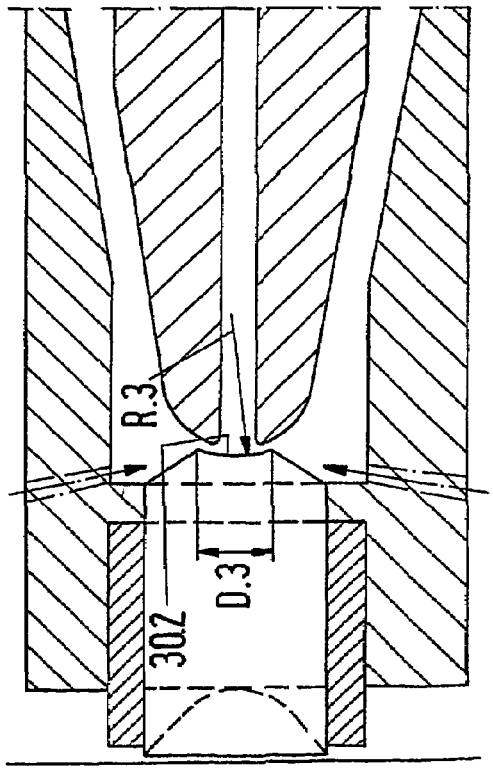

FIGS. 6–6*b* show a similar variant concept, inasmuch as, in this case, it is not a convex face side 30.1 which is provided for, but a concave face side 30.2, with a radius R.3 and an edge length of D.3. The radius R.3 and the edge length D.3 must be determined empirically according to the fibre length and the fibre type. These measures serve to influence the tapering mentioned earlier of the fibre at the inlet aperture mouth.

The elements which do not have characterization identification correspond to the elements in FIGS. 2 to 2*c*.

Figure 7A:
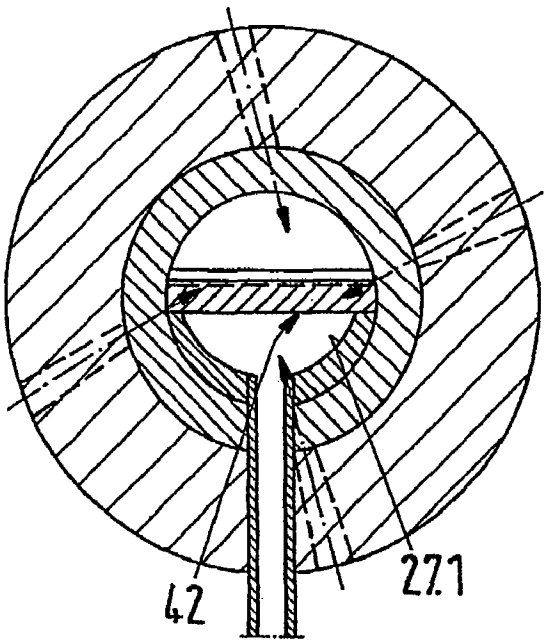
FIG. 7*a* A cross-section according to the section lines IV—IV of FIG. 7.
Figure 7:
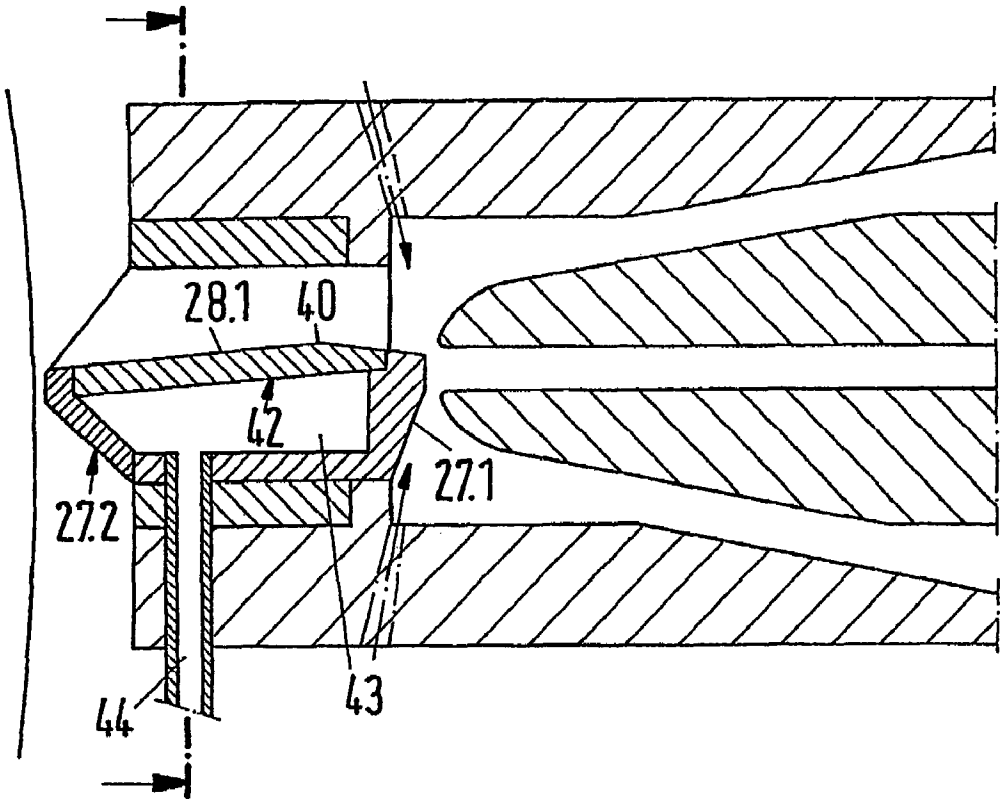
FIG. 7 A further variant of the invention according to FIG. 3.

FIGS. 7 and 7*a* show a variant of FIGS. 3–3*d*, in which the fibre guidance surface consists in this case of a porous place 42 made of sinter material, so that compressed air from a cavity 43 located beneath the porous plate 42 can flow in a very uniform and fine distribution through the porous plate and into the fibres located on this, so that, in a certain sense, a fluidization of the fibres takes place, i.e. a homogenous mingling of air and fibres, which incurs a separation of fibre from fibre, and therefore an increase in the "slipperiness" referred to, i.e. a reduction of the adhesion of the fibres referred to heretofore due to the air located between the fibres.

As a result of this separation, any dirt is more easily loosened and released, with the result that this dirt can be better acquired by the suction air flow at the transition over the intermediate elevation 40. The compressed air for the cavity 43 is introduced via the compressed air feed 44.

The pressure in the cavity 43 is to be determined empirically in accordance with the porous plate and the tolerable air outlet speed from the porous surface, and specifically in such a way that the fibres from this air flow is not raised above a tolerable value from the fibre guidance surface.

The porous plate is accommodated by the parts 27.1 and 27.2 of the fibre conveying element 27, whereby, because they contain the inlet edge and the fibre delivery edge of the fibres, these parts are made of a material which is more resistant to wear than a porous plate.

FIG. 8 shows a nozzle block from FIG. 2.1 in combination with a drafting device 50, consisting of the inlet rollers 51, and apron pair 52 with the corresponding rollers, and the outlet roller pair 53, which delivers the fibre sliver F to the nozzle block 20. The fibres leave the drafting device 50 in a plane which contains the clamping line of the outer roller pair. This plane can be offset in relation to the fibre guidance surface 28 in such a way that the fibre sliver is deflected at the fibre take-up edge 31 (see FIGS. 2 and 2*a* respectively).

FIG. 9 shows, as an alternative to the drafting device, a device in which a fibre sliver 54 is broken up into individual fibres and in the final stage is delivered by means of a suction roller 62 as a fibre sliver F to the nozzle block 20 of FIG. 2.1. This device is the object of a PCT application with the number PCT/CH01/00 217 by the same Applicants, to which application reference is made as a constituent part of this application. An alternative can be derived from U.S. Pat. No. 6,058,693.

The fibre sliver break-up device according to FIG. 9 comprises a feed channel 55, in which the fibre sliver 54 is delivered to a feed roller 56, whereby the fibre sliver is conveyed onwards from the feed roller 56 to a needle roller or toothed roller 61, by which the fibre sliver is broken up into individual fibres. A feed trough 57 presses the fibre sliver 54 against the feed roller, in order thereby to feed the fibre sliver in metered fashion to the needle roller or toothed roller 61. In this situation the hinge 58 and the pressure spring 59 serve to allow for the necessary pressure force.

In the next stage the needle roller 60 transfers the fibres to a suction roller 62. In this situation the dirt, identified by a T, is separated out.

With the help of the suction force, the suction roller 62 holds the fibres tightly in the area delimited by A to B, seen in the direction of rotation, as far as the clamping point K. After this clamping point, the fibres are released for further conveying in the fibre guidance channel 26. In the channel 26, the fibres are acquired by the air flow 25. The release referred to takes place, for example, because the suction effect on the suction roller 62 is no longer present after the clamping point K, for example because the cover connecting the points A and B (shown in FIG. 9) is no longer provided after the clamping point K. The release can, however, be enhanced by means of an air blast B.2, which blows through the holes 63 by means of the channel B.2. This air blast B.2 can, however, be dispensed with. The channel B.2 is supplied with compressed air via the channel B.1.

The fibres leave the suction roller 62 in a plane which contains the clamping line K. This plane can be offset in relation to the fibre guidance surface 28 in such a way that the fibre sliver is deflected at the fibre take-up edge 31 (see FIGS. 2 and 2*a* respectively).

As far as the drafting device from FIG. 8 is concerned, this is a generally known drafting device system, and it is accordingly not considered in any further detail.

From FIGS. 8 and 9, it can be seen that the fibre conveying channel 26 is provided with a fibre guidance surface 28, which is designed without a twist (or without a helix) (see FIGS. 1*a* and 1*c* respectively). The fibre guidance surface 28 leads to a fibre delivery edge 29, which is positioned in relation to the inlet aperture mouth 35 of the yarn guidance channel in such a way that the fiber sliver F must come in contact with the edge 29 in order to enter into the inlet aperture mouth 35. As a result of this, a continuation of a yarn rotation, upstream of the edge 29, is prevented or at least substantially reduced.

It can be seen from the same figures that the fibre conveying channel 26 is located on the one hand entirely on one side of an imaginary plane (not shown) running perpendicular seen looking towards FIG. 2, and contains the mid-line 47 of the yarn channel 45. The fibre conveying channel 26, on the other hand, is also run close to the inlet aperture mouth 35 of the yarn guidance channel 45 in such a way that, in the combination of the two measures, at least a part of the fibre sliver F must be deflected in order to pass out of the fibre conveying channel 26 into the yarn guidance channel 45 (see FIGS. 1*a* and 1*c* respectively, where, as a departure to what has gone before, a substantial distance interval pertains between the end of the fibre guidance channel and the spindle, in order to allow for the provision of the needle 5 in the intermediate space).

In the preferred embodiment (FIGS. 8 and 9), the fibre delivery edge 29 of the fibre conveying channel 26 is provided in a plane E (FIG. 2*c*) parallel to the first plane mentioned, containing the mid-line 47, said plane being arranged at a predetermined interval B from the plane first referred to.

FIGS. 8 and 9 also show that the fibres which in operation leave the fibre conveying channel 26 enter directly into the area (space 22, FIG. 2) in which the eddy flow is present. This also represents a change in relation to the arrangement according to FIG. 1, because in this latter arrangement a distance interval pertains between the end of the fibre guidance channel 13 and the plane in which the outlet aperture mouths of the blower nozzles 3 are located.

It should be appreciated by those skilled in the art that modifications and variations can be made to the embodiments described herein without departing from the scope and spirit of the invention as set forth in the amended claims and their embodiments.

The invention claimed is:

1. A device for the manufacture of a spun thread from a fiber sliver, said device comprising:

a fiber conveying channel with a fiber guidance surface, and a yarn guidance channel having an inlet mouth aperture, said fiber guidance surface disposed to guide fibers conveyed therealong to said inlet mouth aperture;

a fluid generating device that creates eddy currents around said inlet mouth aperture to incorporate individual fibers introduced to said inlet mouth aperture into an end of a yarn being formed in said yarn guidance channel; and said fiber guidance surface further comprising a fiber delivery edge having a shape and disposed relative to said inlet mouth aperture such that the fibers are guided over said delivery edge and conveyed to said inlet mouth aperture in an aligned generally flat planar formation.

2. The device as in claim 1, wherein said fiber delivery edge is defined at an interval distance (A) from said inlet mouth aperture in the direction of fiber flow and a predetermined interval distance (B) from a mid-line axis of said yarn guidance channel in a direction generally perpendicular to said mid-line axis.

3. A device for the manufacture of a spun thread from a fiber sliver, said device comprising:

a fiber conveying channel with a fiber guidance surface, and a yarn guidance channel having an inlet mouth aperture, said fiber guidance surface disposed to guide fibers conveyed therealong to said inlet mouth aperture;

a fluid generating device that creates eddy currents around said inlet mouth aperture to incorporate individual fibers introduced to said inlet mouth aperture into an end of a yarn being formed in said yarn guidance channel; and said fiber guidance surface further comprising a fiber delivery edge having a shape and disposed relative to said inlet mouth aperture such that the fibers are guided over said delivery edge and conveyed to said inlet mouth aperture in an aligned generally flat planar formation; and wherein said fiber guidance surface further comprises an elevation component at a predetermined distance before said fiber delivery edge in the direction of fiber flow, said elevation having one of a straight, curved concave, curved convex, or combined curved concave and curved convex cross-sectional shape.

4. The device as in claim 3, wherein said elevation is at an elevation height above said fiber delivery edge such that dirt particles conveyed in the fiber stream are deflected away as the fibers are deflected by said elevation prior to reaching said fiber delivery edge.

5. The device as in claim 1, wherein said fiber guidance surface comprises a channel-shaped depression extending to said fiber delivery edge, said depression forming fibers conveyed along said fiber guidance surface into a specified width prior to the fibers being conveyed over said fiber delivery edge.

6. The device as in claim 3, wherein said fiber guidance surface is formed at least partially by an air-permeable material that is in communication with a compressed air source such that compressed air flows through said air permeable material for influencing alignment and separation of fibers conveyed along said fiber guidance surface and aiding in separation of dirt particle from the fibers.

7. The device as in claim 6, wherein said air permeable material comprises pores of a size such that the fibers are fluidized by the compressed air passing through said pores.

8. The device as in claim 7, wherein the location of the air permeable material and the volume and speed of the fluidizing air is maintained such that the fibers are not lifted from said fiber delivery edge as they are conveyed to said inlet mouth aperture.

9. The device as in claim 1, wherein said fiber guidance surface terminates in a front face disposed generally perpendicular to a mid-line axis of said yarn guidance channel, said front face having a shape that at least partially determines a shape of said fiber delivery edge.

10. The device as in claim 9, wherein said front face has one of a concave, convex, or wave-shaped profile.

11. A device for the manufacture of a spun thread from a fiber sliver, said device comprising:

a fiber conveying channel with a fiber guidance surface, and a yarn guidance channel having an inlet mouth aperture and a mid-line longitudinal axis, said fiber guidance surface disposed to guide fibers conveyed therealong to said inlet mouth aperture;

a fluid generating device that creates eddy currents around said inlet mouth aperture to incorporate individual fibers introduced to said inlet mouth aperture into an end of a yarn being formed in said yarn guidance channel; and said fiber guidance surface being disposed in a generally flat plane without a helix or twisting component preceding a fiber delivery edge in a direction of fiber flow, said fiber delivery edge having a shape and disposed relative to said mid-line longitudinal axis of said inlet mouth aperture such that the fibers are caused to contact said fiber delivery edge prior to being introduced into said inlet mouth aperture, whereby a tendency for propagation of false twist upstream of said fiber delivery edge is minimized.

12. A device for the manufacture of a spun thread from a fiber sliver, said device comprising:

a fiber conveying channel having a fiber delivery edge, and a yarn guidance channel having an inlet mouth aperture and a mid-line longitudinal axis, said fiber conveying channel disposed to guide fibers conveyed therealong to said inlet mouth aperture;

a fluid generating device that creates eddy currents around said inlet mouth aperture to incorporate individual fibers introduced to said inlet mouth aperture into an end of a yarn being formed in said yarn guidance channel; and said fiber conveying channel disposed entirely above a horizontal plane containing said mid-line longitudinal axis such that the fibers are deflected around said fiber delivery edge prior to being introduced into said inlet mouth aperture.

13. The device as in claim 12, wherein said fiber conveying channel is defined in a plane generally parallel to said horizontal plane.

14. The device as in claim 13, wherein said fiber conveying channel is disposed relative to said inlet mouth aperture such that fibers leaving said fiber conveying channel enter directly into an area in which the eddy currents are present.

15. A device for the manufacture of a spun thread from a fiber sliver, said device comprising:

a fiber conveying channel with a fiber guidance surface, and a yarn guidance channel having an inlet mouth aperture, said fiber guidance surface disposed to guide fibers conveyed therealong to said inlet mouth aperture;

a fluid generating device that creates eddy currents around said inlet mouth aperture to incorporate individual fibers introduced to said inlet mouth aperture into an end of a yarn being formed in said yarn guidance channel; and said fiber guidance surface comprising a fiber delivery edge disposed at an interval distance (A) from said inlet aperture mouth in a range of from about 0.1 to 1.0 mm and at an interval distance (B) from a mid-line axis of said yarn guidance channel in a direction generally perpendicular to said mid-line axis in a range of from about 10% to about 40% of a diameter of said inlet mouth aperture.

16. The device as in claim 2, wherein said distance interval (A) is in a range of from about 0.1 mm to about 1.0 mm, and said distance interval (B) is in a range of from about 10% to about 40% of a diameter of said yarn guidance channel.

17. The device as in claim 4, wherein said elevation is at a maximum distance (M) from said fiber delivery edge of about 50% of a mean fiber length of fibers conveyed through said device.

18. The device as in claim 17, wherein said elevation has an elevation height that is in a range of from about 10% to about 15% of said distance (M).

19. The device as in claim 5, wherein said depression extends a maximum distance (P) from said fiber delivery edge of about 50% of a mean fiber length of the fibers conveyed through said device, and has a curved cross-section with a predetermined radius.

20. The device as in claim 1, wherein said fiber delivery edge comprises a transverse width that is in a proportion of about 1:5 with a diameter of said yarn guidance channel.

* * * * *